United States Patent [19]

Koya

[11] Patent Number: 4,714,102

[45] Date of Patent: Dec. 22, 1987

[54] CASTING METHOD AND AN APPARATUS THEREFOR

[75] Inventor: Hirokuni Koya, Zama, Japan

[73] Assignee: Toshiba Machine Co., Ltd., Tokyo, Japan

[21] Appl. No.: 1,021

[22] Filed: Jan. 6, 1987

[30] Foreign Application Priority Data

Jan. 11, 1986 [JP] Japan ..... 61-002892
Jan. 11, 1986 [JP] Japan ..... 61-002893

[51] Int. Cl.[4] ..... B22D 17/32

[52] U.S. Cl. ..... 164/457; 164/156; 164/113; 164/303; 164/500; 164/147.1; 164/133; 164/135

[58] Field of Search ..... 164/457, 155, 156, 113, 164/119, 303, 306, 500, 147.1, 133, 135

[56] References Cited

U.S. PATENT DOCUMENTS 4,213,494 7/1980 Carbonnel ..... 164/500 X

FOREIGN PATENT DOCUMENTS 40-12971 6/1965 Japan ..... 164/156
52-23602 6/1977 Japan ..... 164/457
55-112159 8/1980 Japan ..... 164/457
57-19148 2/1982 Japan .

*Primary Examiner*—Kuang Y. Lin
*Attorney, Agent, or Firm*—Young & Thompson

[57] ABSTRACT

A casting method and an apparatus therefor are disclosed, in which a molten material in a retaining furnace is poured through a supplying conduit directly into a cavity of a mold at a low pressure. A portion of the conduit is provided with an electromagnetic induction pump while the furnace is provided movably therein with a level-detecting sensor for detecting a level of the molten material in the furnace and generating a signal which provides instructions of computing, commanding and controlling an excitation voltage of the electromagnetic induction pump, thereby to optimize the injection pressure and the amount of the molten material in the conduit when the molten material is poured into the cavity of the mold through the conduit.

4 Claims, 3 Drawing Figures

CASTING METHOD AND AN APPARATUS THEREFOR

FIELD OF THE INVENTION

This invention relates to a low pressure casting system, more particularly to a casting method and an apparatus therefor improved in supplying means for a molten material and pressure control for feeding the same.

BACKGROUND OF THE INVENTION

A casting apparatus has hitherto been known which comprises a retaining furnace of a hermetical structure for a molten material, from which is extended a supplying conduit for pneumatically injecting the molten material at a low pressure directly into a cavity of a mold.

FIG. 1 illustrates a construction of a conventional casting apparatus of a pneumatic controlling system, in which reference 10 stands for a retaining furnace of a molten material, which is hermetically closed by a cover plate 12. The cover plate 12 at its central portion is sealingly traversed by a supplying conduit 14 for the molten material, which communicates with an air pressure system 16. The air pressure system 16 introduces a pressure air from a required air source through an air pressure controlling device 20 into the furnace 10. The supplying conduit 14, on the other hand, communicates through a fixed die plate 22 with a passage 26 for the molten material into a lower mold 24 which at its upper part is joined with an upper mold 28. Between the lower and the upper molds 24, 28 is arranged a cavity 30. Furthermore, a portion of the conduit 14, which is extended externally from the cover plate 12, is provided circumferentially with a gas burner 32 for preventing the molten material from solidifying in the supplying conduit 14 until the molten material poured into the cavity 30 of the mold is solidified therein.

In the conventional casting apparatus of low pressure thus constructed, the controlled air pressure is supplied from the air pressure system 16 to the hermetical retaining furnace 10, while the injection pressure of the molten material from the conduit 14 into the cavity 30 is kept constant for casting. Since the air pressure from the air pressure system 16 is released after the casting cycle is completed, the molten material in the supplying conduit 14 flows back into the retaining furnace 10, so that the level B in the conduit 14 may be same as the level A in the furnace 10.

In accordance with such conventional casting apparatus, the air pressure to the furnace 10 is controlled to maintain the constant injection pressure, resulting in a delayed response to the injection control of the molten material and a disadvantageously increased cycle time. Furthermore, in case of a programming control of the injection pressure of the molten material into the cavity 30, the same reason may cause reduced controllability and impossibility of fine control. Consequently, when a product of a complex shape should be molded, the molten material cannot adequately flow into extreme ends of the cavity, resulting in a defective product.

At each casting cycle the molten material in the conduit 14 may vary its surface level B through switching control of the air pressure, thereby to entrap air into the molten material in the conduit 14 and thus to produce a defective product having voids.

Furthermore, in the conventional casting apparatus, as shown in FIG. 1, a single conduit is arranged under the center of the mold and communicates with the retaining furnace for injecting the molten material from a single injection opening. As a result, the molten material cannot reach extreme ends of the cavity for the complex-shaped mold, resulting in increased production of defective articles.

SUMMARY OF THE INVENTION

Accordingly, an object of the invention is to provide a casting method and an apparatus therefor, which utilizes an electromagnetic induction pump instead of the conventional air pressure control system for controlling the injection pressure of the molten material and ensuring optimal retention of the molten material both in the supplying conduit and in the retaining furnace, thereby to achieve smooth casting operation and to produce cast articles of constant and high quality.

Another object of the invention is to provide a casting method and an apparatus therefor, which utilizes an optimal number of injection openings arranged at optimal sites for obtaining smooth flow of the molten material depending on the shape of the cavity, which openings may work either simultaneously or with respective time difference, thereby to produce cast articles of constant and high quality.

In order to achieve the above objects, one aspect of the invention provides a casting method in which a molten material in a retaining furnace is poured through a supplying conduit directly into a cavity of a mold at a low pressure, characterized in that a portion of the conduit is provided with an electromagnetic induction pump while the furnace is provided movably therein with a level-detecting sensor for detecting the level of the molten material in the furnace and generating a signal which provides instructions for computing, commanding and controlling the excitation voltage of the electromagnetic induction pump, thereby to optimize the injection pressure and the amount of the molten material in the conduit when the molten material is poured into the cavity of the mold through the conduit.

Another aspect of the invention provides a casting apparatus for pouring a molten material of a retaining furnace through a supplying conduit directly into a cavity of a mold at a low pressure, which comprises an exciting coil of an electromagnetic induction pump surrounding the conduit at a location near the cavity of the mold, a vertically movable level-detecting sensor arranged in the furnace for detecting the level of the molten material, a computer means for receiving a detected signal from the sensor and computing an excitation voltage of the electromagnetic induction pump in order to optimize an injection pressure and an amount of the molten material in the conduit when the molten material is poured into the cavity of the mold through the conduit, and a voltage controller for energizing and controlling the exciting coil based on an excitation voltage command from the computer means.

For better understanding the invention will be described hereinbelow in more detail for the preferred embodiments with reference to the accompanying drawings.

PREFERRED EMBODIMENTS OF THE INVENTION

Figure 1:
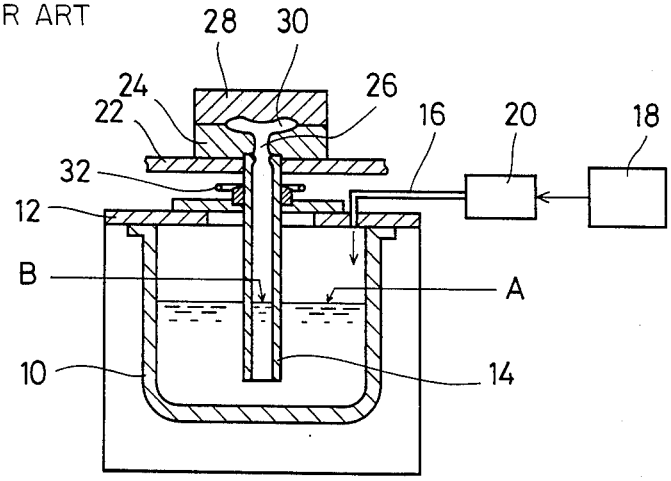
FIG. 1 PRIOR ART
FIG. 1 shows a schematic construction of a conventional casting apparatus of a low pressure type.
Figure 2:
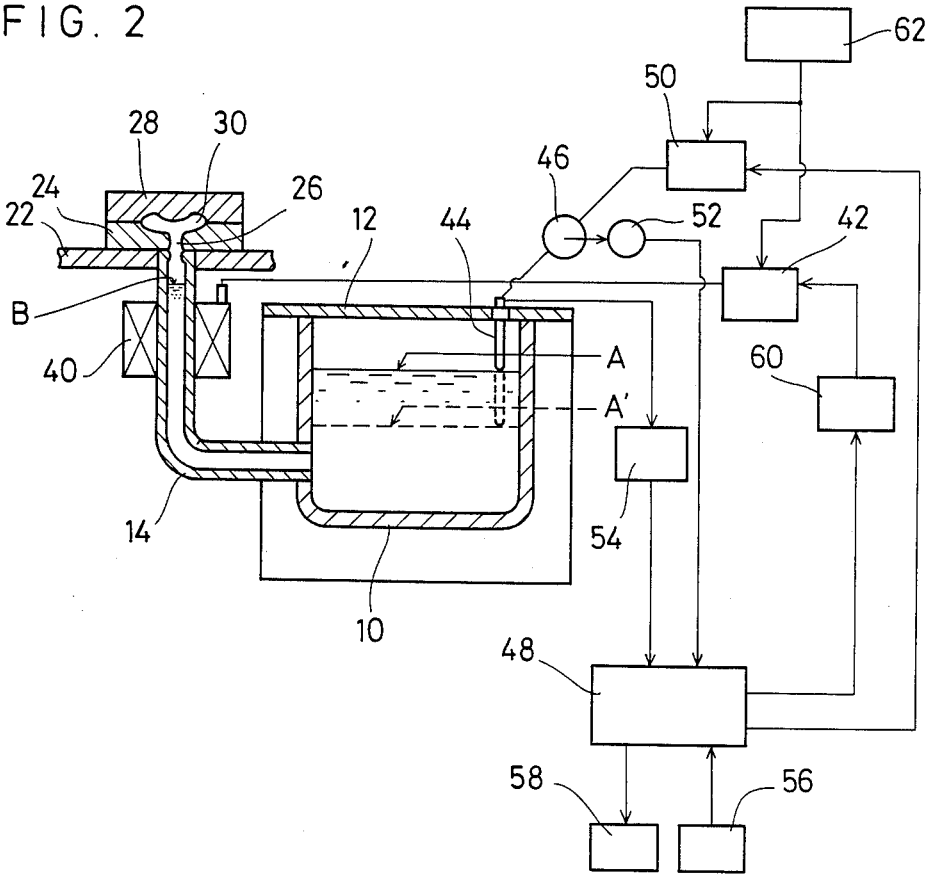
FIG. 2 shows a schematic construction of the casting apparatus and a controlling system therefor according to one embodiment of the invention.

FIG. 2 illustrates one embodiment of the casting apparatus according to the invention, in which the same elements as in FIG. 1 are represented with same references for convenience. The construction of the retaining furnace 10, the supplying conduit 14 and the mold 24, 28 is identical to that of the conventional apparatus. In accordance with the invention, the supplying conduit 14 is provided in the vicinity of its connection to the die plate 22 with an electromagnetic induction pump. For this purpose, according to this embodiment, the conduit 14 is extended from a lower side of the furnace 10, which at its riser is surrounded in the vicinity of the fixed die plate 22 by an exciting coil 40 of the electromagnetic induction pump. This electromagnetic induction pump may be regulated for its excitation voltage by, for example, a three-phase alternating current supplied to the exciting coil 40 by a voltage controller 42, thereby to transport the molten metal by means of its electromagnetic force and inject the same into the cavity 30 of the mold. In order to control the voltage controller 42, the following control system is utilized.

Namely, reference 44 represents a vertically movable level-detecting sensor which is inserted through the cover plate 12 into the retaining furnace 10 and controlled by a servo-motor 46. This servo-motor 46 may be controlled by a signal from an amplifier 50 based on an instruction signal from a micro-computer 48. The servo-motor 46 is connected to a pulse generator 52 for detecting the vertical position of the sensor 44 and outputting a detected position signal into the micro-computer 48. Furthermore, the level-detecting sensor 44 may output the detected signal of contact with the metal surface into the micro-computer 48 through a coverter 54. The micro-computer 48 is inputted with an injection pressure and its programmable variation pattern as the optimal casting condition by means of an inputting device 56, such as a key-board, while optionally confirming a CRT display 58, and compares the level-position data in the furnace 10 outputted from the pulse generator 52 for computing the optimal injecting condition of the molten metal and outputting a control instruction of the electromagnetic pump. Then, the control instruction from the micro-computer 48 is inputted through the amplifier 60 into the voltage controller 42 for energize the exciting coil 40 of the electromagnetic induction pump. Reference 62 stands for a power source for driving the servo-motor 46 to move the exciting coil 40 of the electromagnetic induction pump and the level-detecting sensor 44.

In this embodiment of the casting apparatus according to the invention, the level B of the molten material in the conduit 14 may input the detected signal from the level-detecting sensor 44 to the micro-computer 48 for the computation, transmit the resulting output command to the voltage controller 42 through the amplifier 60 and control the excitation voltage of the exciting coil 40, thereby to inject the molten material of the conduit depending on the predetermined injection program and to maintain the constant level B after the pouring procedure. In this case, the level-detecting sensor 44 energizes the servo-motor 46 until its sensing element is contacted by the surface of the molten material, thereby to allow the sensor 44 to move vertically and to contact with the level A. Then, a temperature sensor or a current sensor forming the sensing element of the level-detecting sensor 44 is actuated to introduce its output through the converter 54 into the micro-computer 48 which in turn outputs a command for discontinuing the drive of the servo-motor 46 through the amplifier 50. Simultaneously, the position signal detected in the pulse generator 52 connected to the servo-motor 46 is inputted to the micro-computer 48, which on the basis of its level data may compute the excitation voltage of the exciting coil 40.

Thus the melt level A in the furnace 10 is computed by the servo-motor 46 and the pulse generator 52. The relation between the melt level A in the furnace 10 and the excitation voltage EB of the electromagnetic induction pump 40 necessary for maintaining the melt level in the conduit 14 at a predetermined value B has been previously programmed in the microcomputer 48.

When, for example, a required excitation voltage is supplied to the electromagnetic pump 40 for injecting the melt into the mold, the level A in the furnace 10 is decreased. A variation of the level A is detected by the detecting sensor 44 and transmitted to the microcomputer 48. As a result, the excitation voltage EB corresponding to the melt level after the variation is processed in the microcomputer 48. Thus, after the electromagnetic induction pump 40 has completed its melt injection, the return of the excitation voltage of the pump 40 to the value EB computed by the microcomputer 48 ensures the maintenance of a constant melt level B.

In accordance with this embodiment in which the supplying conduit is provided with the electromagnetic induction pump for transporting the molten material due to its electromagnetic force as described above, the efficient retention of the hot molten material may be achieved. Furthermore, the level of the molten material in the furnace may be detected to provide a signal for controlling the electromagnetic induction pump and thus achieving the optimal pressure and amount of injection, thereby to produce cast articles of high quality on a mass scale.

Figure 3:
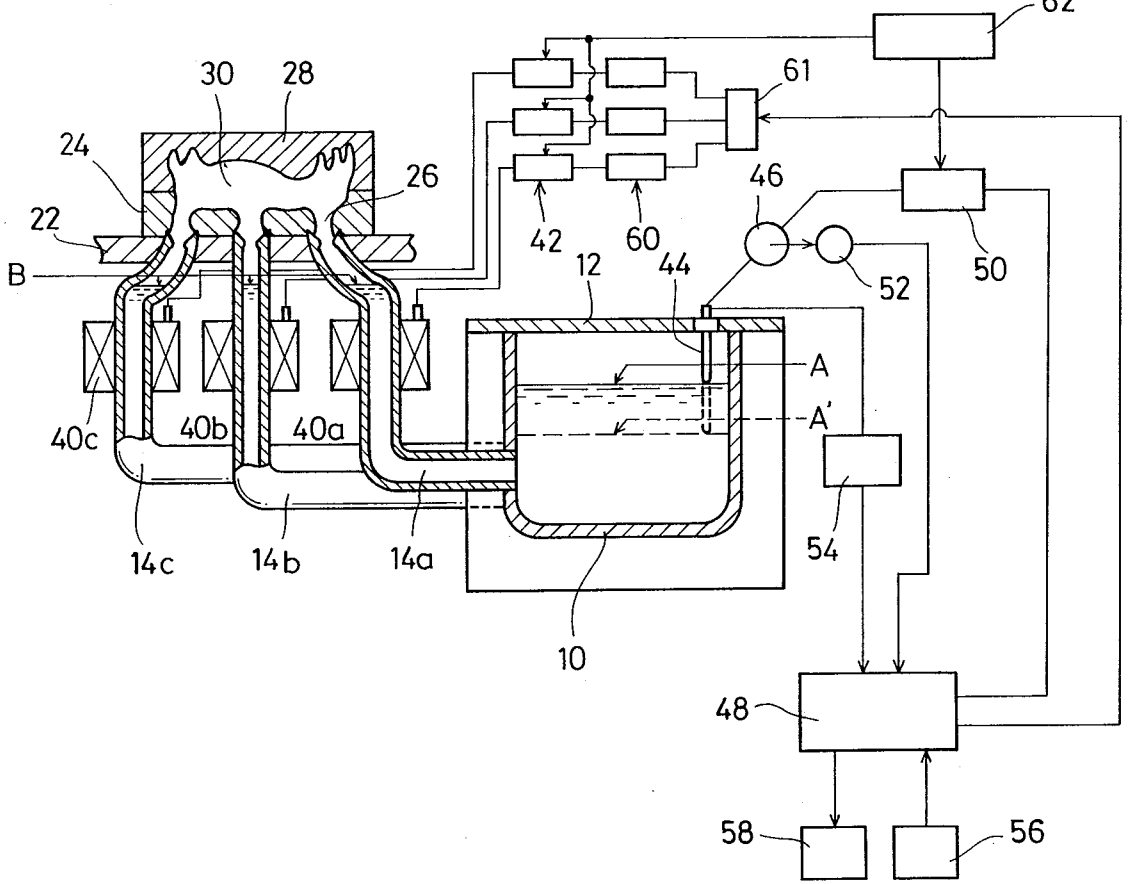
FIG. 3 shows a schematic construction of the casting apparatus and a controlling system therefor according to another embodiment of the invention.

FIG. 3 illustrates another embodiment of the casting apparatus according to the invention, in which the mold 24, 28 has a cavity 30 of a complex shape. In order to achieve a smooth flow of the molten material, the cavity 30 at its suitable locations is provided with a plurality of independent conduits **14*a*, 14*b* and 14*c* which communicates through the fixed die plate 22 with a passage 26 of the lower mold 24. Each of these conduits 14*a*, 14*b*, 14*c* also communicates with the lower side of the furnace 10 and is surrounded in the vicinity of its connection to the die plate 22 by the respective exciting coil 40*a*, 40*b*, 40*c* constituting the electromagnetic induction pump. Each electromagnetic induction pump may transport and inject the molten metal into the cavity 30 due to its electromagnetic force by regulating the excitation voltage of, for example, a three-phase alternating current supplied to the exciting coil 40*a*, 40*b*, 40*c* by each voltage controller 42. The control system for the voltage controller 42** is in principle identical to that of the embodiment of FIG. 2 and therefore for its detailed description may be omitted.

In accordance with this embodiment, the level B of the molten metal in each conduit **14*a*, 14*b*, 14*c* may input the detected signal from the level sensor 44 into the microcomputer 48 for the computing treatment and transmit the resulting output command to the voltage controller 42 through a selector switch 61 and an amplifier 60 for controlling the excitation voltage of each exciting coil 40***a*, 40*b*, 40*c*, thereby to inject the molten metal of each conduit 14*a*, 14*b*, 14*c* depending on the predetermined injection program and thus keep the constant level B of the molten metal after the pouring procedure. In this case, the level-detecting sensor 44 energizes the servo-motor 46 until its sensing element is contacted by the surface of the molten material, thereby to allow the sensor 44 to move vertically and to contact the level A. Thus, a temperature sensor or a current sensor forming the sensing element of the level-detecting sensor 44 is actuated to introduce its output through the converter 54 into the micro-computer 48 which in turn outputs a command for discontinuing the drive of the servo-motor 46 through the amplifier 50. Simultaneously, the position signal detected in the pulse generator 52 connected to the servo-motor 46 is inputted to the microcomputer 48, which on the basis of its level data may compute the excitation voltage of the exciting coil 40*a*, 40*b*, 40*c*.

Thus in accordance with this embodiment, depending on the material flow through each conduit into the cavity 30, each of the electromagnetic induction pumps may be controlled in order to achieve the optimal condition for a pressure, a timing and an amount of the injection in each conduit 14*a*, 14*b*, 14*c*.

As described hereinabove, in accordance with the invention, the electromagnetic induction pump permits the retention of the constant level of the molten material in the conduit regardless of variation of the level in the furnace and thus the proper control of the injection pressure under constant casting conditions. Especially for a cavity of complex shape, the plural conduits may be connected to the optimal locations for obtaining excellent flow of the molten material and pour the latter with the proper pressure and amount of injection with the predetermined timing, thereby to produce excellent articles of high quality on a large scale.

Furthermore, in accordance with the invention, the electromagnetic induction pump may not only retain the optimal level of the molten material in the conduit but also provide a heating action of an eddy current due to the electromagnetic induction effect as well, thereby to effectively prevent the molten material from solidifying in the conduit during the waiting time for solidification after the pouring procedure.

In addition, the pressure variation pattern during the injection procedure may be selectively set or varied by the micro-computer and the constant optimal level of the molten material in the conduit may be retained, so that air inclusion into the molten material may be avoided and the productivity may be improved due to reduction of the length of the casting cycle.

Although the invention has been described hereinabove as to preferred embodiments for better understanding, it will be appreciated that a number of variations and modifications may be made without departing from the spirit and scope of the invention.

What is claimed is:

1. A casting method for use with a retaining furnace for molten material which communicates with a mold through a supply conduit having an electromagnetic induction pump for impelling a molten material from the retaining furnace through the supply conduit directly into a cavity of a mold at low pressure, the method comprising providing in the retaining furnace a level-detecting sensor which is vertically movable by means of a servo-motor and generates a signal of the detected level, coupling the servo-motor to a pulse generator for generating a signal of the position of the level of the molten material, storing in a computer data relative to a predetermined injection pressure and variations thereof to determine optimum casting conditions of the molten material, inputting into the computer the detected level signal from the level detecting sensor in the form of a level position signal from the pulse generator for computing the optimum injecting conditions, and outputting from the computer a control instruction to a voltage control device of the electromagnetic induction pump such as to maintain constant the melt level in the supplying conduit between casting operations regardless of variation in the melt level of the furnace.

2. A casting method according to claim 1, and causing the cavity with the mold to communicate with a plurality of respective supply conduits, providing each of said supply conduits with an electromagnetic induction pump for controlling the timing, pressure and amount of injection of the molten material through each said conduit, and maintaining the same melt level in all of said supply conduits.

3. A casting apparatus for use with a retaining furnace for a molten material, which retaining furnace communicates with a mold through a supply conduit, the supply conduit having an electromagnetic induction pump for impelling molten material from the retaining furnace through the supply conduit directly into a cavity of a mold at a low pressure, the retaining furnace having therein a level-detecting sensor which is vertically movable, a servo-motor for vertically moving the sensor, said sensor generating a signal of the detected level of molten material in the furnace, a converter for outputting the detected level signal and a pulse generator coupled with the servo-motor for generating a signal of the level position of said level sensor, a computer and controlling means for previously storing data relative to injection pressure and a variation thereof to achieve optimum casting conditions of the molten material, means for inputting the detected level signal from the level-detecting sensor in the form of the level position signal from the pulse generator for computing the optimum injecting conditions, and means for outputting a control instruction from the computer to a voltage control device of the electromagnetic induction pump so as to maintain constant the melt level in the supply conduit regardless of variations in the melt level in the furnace between casting operations.

4. Casting apparatus according to claim 3, there being a plurality of said supply conduits communicating with different portions of the mold cavity, each of said conduits having adjacent the cavity an exciting coil of said electromagnetic induction pump.

* * * * *